109-11 SR
10/24/78 XR 4,121,523

United States Patent [19]
Hastings

[11] 4,121,523
[45] Oct. 24, 1978

[54] TRANSACTION SECURITY SYSTEM AND MODULAR TRANSACTION PROCESSING CENTER

[76] Inventor: Otis H. Hastings, 130 E. Crescent Ave., Mahwah, N.J. 07430

[21] Appl. No.: 827,593

[22] Filed: Aug. 25, 1977

Related U.S. Application Data

[63] Continuation-in-part of Ser. No. 602,404, Aug. 7, 1975, abandoned, and a continuation-in-part of Ser. No. 825,174, Aug. 17, 1977.

[51] Int. Cl.[2] ..... E05G 5/02
[52] U.S. Cl. ..... 109/2; 109/5; 109/7; 109/11; 109/48
[58] Field of Search ..... 49/41; 109/2-8, 109/10-13, 17, 19, 45, 48, 57, 67, 68, 73; 312/33, 196

[56] References Cited

U.S. PATENT DOCUMENTS

| | | | |
|---|---|---|---|
| 60,191 | 12/1866 | Horn | 109/48 |
| 1,419,960 | 6/1922 | Dell | 109/4 |
| 1,864,437 | 6/1932 | Inman et al. | 109/4 |
| 1.924,365 | 8/1933 | Mariotti | 312/33 |
| 2,081,271 | 5/1937 | Ellithorpe | 109/7 |
| 2,436,569 | 2/1948 | Halter | 312/33 |
| 2,593,233 | 4/1952 | White | 312/196 X |
| 2,984,194 | 5/1961 | Jennings | 109/4 |
| 3,046,914 | 7/1962 | Sandberg | 109/5 |
| 3,055,319 | 9/1962 | Goerz | 109/12 |

FOREIGN PATENT DOCUMENTS

| | | | |
|---|---|---|---|
| 1,467,369 | 3/1977 | United Kingdom | 49/41 |

*Primary Examiner*—Mervin Stein
*Assistant Examiner*—David H. Corbin

[57] ABSTRACT

A transaction security device comprising a booth of a material and construction capable of selective voluntary entry and involuntary personnel retention and incorporating a transaction interface; entrance means for said booth; a closure for said entrance means, and control means adapted to secure and unsecure at least said entrance means; and cooperating with said booth, disposed, therein, or indeed independent thereof, at least one secondary enclosure adapted to contain apparatus disposed upon at least one turntable within a housing module composed of an enlosure, portions of which are independently rotatable about said turntable and the devices disposed thereon; and means for access to the interior of said housing and with said transaction interface.

18 Claims, 21 Drawing Figures

TRANSACTION SECURITY SYSTEM AND MODULAR TRANSACTION PROCESSING CENTER

BACKGROUND OF THE INVENTION

This application is a continuation-in-part of my copending application Ser. No. 602,404 filed Aug. 7, 1975, now abandoned, entitled "TRANSACTION SECURITY SYSTEM," and my copending continuation application filed Aug. 17, 1977 entitled "TRANSACTION SECURITY SYSTEM," Ser. No. 825,174.

Development of devices providing security for the dealer or teller as well as security for the transaction itself, where items of value are being transferred or held by the dealer or teller and the agency he represents, has been a continuing concern that has assumed increasing significance with the passing years. Attempted means for providing an adequate degree of protection have assumed a varity of forms. Most such security devices are conceived for use in banks and similar institutions which are seen generally to yield the richest and most readily convertible rewards to those intent on appropriation of items of value by physical force or threat of physical force. Accordingly, and for convenience, most of the discussion appearing herein will be in terms of such institutions and facilities. It will, of course, be obvious that the present invention has application, however, to payroll offices, tax collection agencies, ticket offices and other institutions and businessess apparent to those skilled in the art to which the present invention pertains.

Among the most commonly employed security apparatus heretofore has been closed circuit television systems wherein television cameras are placed strategically about the area in which transactions involving the transfer or custody of articles of value occur. The cameras are desinged to record pictorially on tape any illegal acts occuring in the transaction area. These systems have often been rendered inoperative by covering the lenses of the television cameras which are normally placed at a height sufficient to oversee an area while permitting a sharply defined image of the robber or other miscreant. At greater heights, the cameras have been known to give an insufficiently distinct image to assure later identification. In any event, masks or other disguise may readily defeat the objective of identification. Similar devices using movie cameras have also been utilized, but have been known to fail for the same reasons and, on occasion, for lack of adequate film. Futher these systems provide only surveillance and do not serve physically to restrain a felon or protect the teller, dealer or clerk from harm or intimidation.

More recetly, and increasingly, resort has been had to automated equipment mounted in unprotected stations on building exteriors, for example, in the belief that they were invulnerable to harm or exploitation. This assessment has proven to be in error, however, and these devices have been frequently pummeled and damaged with expensive equipment replacement costs.

In addition, insofar as devices of this sort are automatic paying or receiving machines coming under the authority of the Federal Reserve Board, they are required to meet the severe regulatory construction requirements of Regulation P(12 CFR 216); and, once installed, have not previously been capable of ready removal or relocation.

Further, single or multiple electronic data processing apparatus or other specialty equipment used separately or in support or cooperation with a manual transaction system or automatic transaction equipment also requires, normally, a closely controlled environment in which to function. This environment has been provided usually, heretofore, by placing all of an organization's data processing apparatus except, for example, remotely disposed terminals and the like, in a single large room where overall conditions are maintained substantially uniform. To accomplish this is expensive, the location of the equipment is often inconvenient and an accommodation to necessity rather than efficient utilization; and a power failure or the like will necessitate, in the absence of an auxiliary power supply, a shut-down of an organization's entire electronic data processing system; and in modern terms where banks are concerned, for example, will cause a closing of the entire business enterprise, as well as other enterprises dependent upon it. This vulnerability exists as well with sensitive government installations and will ordinarily disconnect and disarm the protective systems and apparatus used to secure the electronic data processing system itself against injury.

Turning to consideration of the transaction security aspect of the present invention, however, means have, of course, been developed heretofore, having as their objective the protection of bank tellers or persons similarly engaged in deaing in other items of value with members of the public.

Thus, U.S. Pat. No. 2,460,917 is directed to a cashier or teller safety booth, incorporating a pivoted bin adapted to be swung out through the bullet-resistant wall protecting the cashier from potential harm by the customer or other member of the public; the bin providing a conveyance for any articles of value to be transmitted between customer and teller. Devices such as this, designed to limit physical exposure of the teller while providing facility of communication between teller and customer, have often proved unsatisfactory to prevent robbery, escape of the robber, or injury to a guard or other bank personnel since the transaction area is open to the public and the robber has freedom to attempt escape, at least in terms of the security apparatus described, at any time.

U.S. Pat. No. 2,700,944 describes, in turn, a protective apparatus comprising a hinged screen which may be activated to spring up and block the transaction interface between the teller and any threatening customer or other member of the public. The use of this device demands timing and a readiness by the teller or cashier to chance injury and otherwise incorporates the difficulties inherent in U.S. Pat. No. 2,460,917 described briefly hereinabove.

U.S. Pat. No. 3,537,409 provides additional protection in bank security systems wherein the teller station is capable of being locked and removed from control of those within the bank so that even in the event of threat, the teller, for example, cannot unlock the teller enclosures, drawers, vault or the like. A significant difficulty with this system, is that it must be activated, which will normally occur only upon performance of an overt act of hostility, which, if sufficiently rapid, or reacted to with insufficient speed, may bar activation of the system completely.

In the event, therefore, that a transaction enclosure or booth could be devised wherein the dealer, teller, cashier or other similarly engaged person were protected from injury or threat, or a banking macine or other transaction device employed to replace the foregoing person, is rendered invulnerable to attck by a customer or other person on the opposing side of a bullet-resistant transaction interface defined in one side of said booth or enclosure, and the customer enabled to engage in transactions across said interface only so long as he was detained from leaving said enclosure, a significant advance in the state of the art would be attained.

A further advance of similar importance would be had if means could be provided for access between a transaction enclosure, such as the foregoing, and an automated transaction processing device or apparatus contained in a protective module disposed within said booth, wherein the module would meet the requirements, for example, of the Fereral Reserve System as described in 12 CFR 216, and would be adapted for ready removal and relocation; and accessible through a single site, but selectively, for both servicing and customer transactions.

If, additionally, a module could be so constructed as to provide for containment of one or more units of electronic data processing equipment under the precise environmental conditions required for their maintenance and could be employed for these latter purposes independently of its integral cooperation in a transaction security booth, a further and material step forward in the relevant art would be secured.

It is, accordingly, an object of this invention to provide a transaction security system that includes a bullet- or projectile-resistant booth wherein transactions with a teller, banking or other automated transaction machine or custodial entity normally occur only when the customer is prevented from leaving the booth.

An object of this invention, too, is to provide control means associated with said enclosure or booth and integrated therewith so that when the entrance to said booth is opened the transaction interface of said booth is closed and when said door is closed said interface may be open.

Another object of this invention is the provision of means adapted to preempt and over-ride said integrated control means.

A further object of this invention is to provide in cooperation within said booth a module for said automated transaction equipment wherein all aspects of the equipment can be made selectively accessible at a single site.

A still futher object of this invention is to provide protection for, an environmental control of, such conditions as temperature and humidity about said equipment, and to do so in a manner that necessitates minimal spatial requirements and combines this feature with ready module and equipment assembly, disassembly and mobility.

SUMMARY OF THE INVENTION

These and other objects are achieved in accordance with the practice of the present invention by provision of a booth of a material and construction capable of selective voluntary entry and involuntary detention of personnel present within the booth and preferably one where at least one wall or a portion thereof, and preferably the entire interior wall, of said booth is substantially impact-resistant, whether to bullets or other projectiles; an entrance and transaction interface defined in the wall of said booth; a door or closure means to at least said entrance, and control means for securing and unsecuring of said closure means and means to over-ride said door securing and unsecuring means. Cooperating with the foregoing booth, and disposed therein, or indeed independent thereof, in a preferred embodiment of the invention, is at least one secondary enclosure or module, hereinafter caled the "transaction processing center" adapted to contain apparatus, such, for example, as electronic data processing apparatus, transaction processing equipment or other devices; said secondary enclosure comprising one or more turntables upon which said equipment is positioned; a stationary wall; at least one access means to the interior of said enclosure; and one or more second closure means rotatable about said one or more turntables, and registrable with aid access means. The foregoing housing and one or more turntables defining said module can be such as to enable maintenace of an environment controlled not only as to temperature and humidity for as little as a single unit of data processing apparatus, but with fire detection and control means inbuilt as well. The secondary closure or module can also be disassociated from said first or outer booth and employed independently thereof in an alternative embodiment of the invention for the purpose, illustratively, of containment of data processing apparatus or specialty equipment, and valuable items including currency, documents, securities and the like. Also provided, according to the invention, for use as a means for access to said module or said booth, or independently thereof as a means of control of controlling physical communication and movement through a passage are entry means composed of at least two vertically disposed shields, arcuately shaped in horizontal section and movable about a common axis to effect entry and egress therethrough in a manner so that at least one of said shields occludes communication or movement with that portion of the passage from which entry is sought before communication is permitted into that portion of the passage into which entry is sought.

BRIEF DESCRIPTION OF THE DRAWINGS

The foregoing and additonal objects, features and advantages of this invention will be apparent to those skilled in the art from the following detailed description of preferred embodiments of the invention when taken in conjunction with the accompanying drawings in which.

Figure 1:
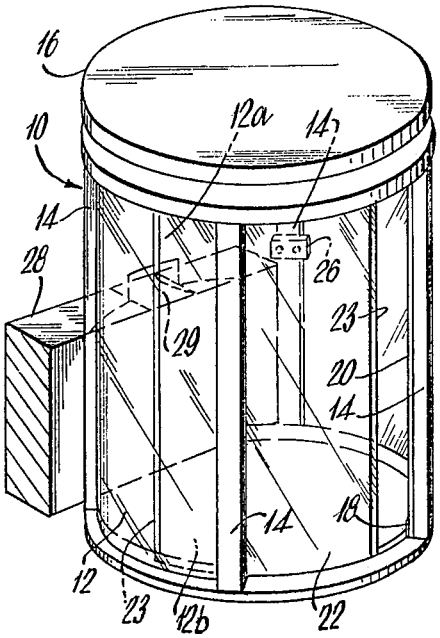
FIG. 1 is a perspective view of a transaction security booth of the invention.
Figure 2:
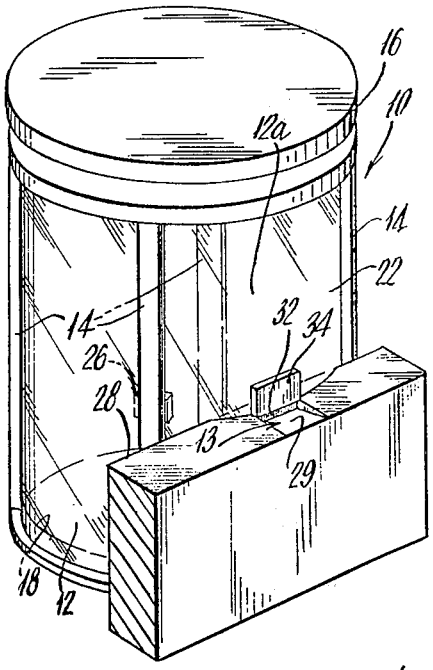
FIG. 2 is a further perspective of the transaction security booth of FIG. 1.
Figure 3:
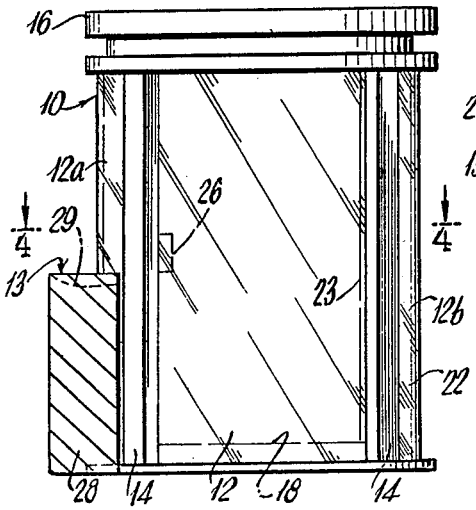
FIG. 3 is a side elevational view of the transaction security booth of FIG. 1 and FIG. 2.
Figure 4:
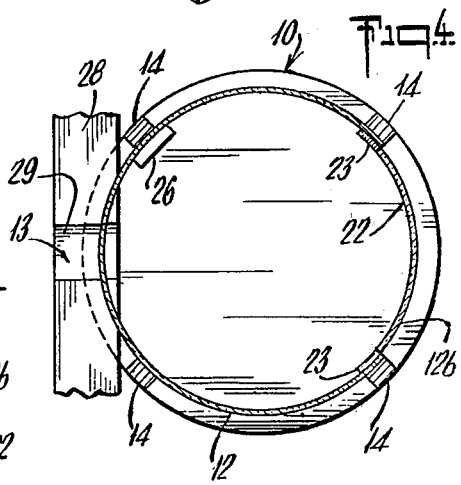
FIG. 4 is a horizontal sectonal view of the transaction security booth taken along the line 4—4 of FIG. 3.

With particular reference to FIG. 1 through 4 of the drawings, the booth 10 is shown having a plurality of panels 12 formed of a material and construction capable of personnel retention and having, in addition, and preferably, transparent and impact, including bullet and projectile, resistant properties, including one such panel 12*a* modified to incorporate a transaction interface 13. The panels 12 (and 12*a*) are mounted within at least equally impact-or-bullet-resistant, rigid vertical suport members 14 which are secured to the periphery of the booth ceiling 16 and, optionally, the base or floor 18 thereby forming a housing. It is of course, also feasible to employ a single panel 12 to provide the booth wall or housing. The entance 20 to the booth 10 is partially bridged, as seen in FIG. 1, by the sliding closure means 22 which is mounted on tracks or a rotatable support and drive shaft (not shown) in either or both of the ceiling 16 and base 18 members. In a preferred embodiment, the closure means 22 is driven by a motor and worm gear (not shown) and latching is inherent in the drive mechanism, which can be driven from only on end; that is, the closure means 22 can only be moved by operation of the motor. Thus, when the entrance 22 is closed, it is also secured and cannot be moved manually and reversal of the motor is required to open the door. It will be obvious, however, that any standard mode of operation known and readily available to one skilled in the art may be utilized to effect the closing and consequent securing, and opening and consequent insecuring, of the entrance 20. It will also be evident that securing and unsecuring of the closure means can be accomplished as a separate function associated with closing and opening of the closure means.

An additional panel 12*b*, similar in construction to those 12 forming the wall of the booth and also therefore transparent and bullet and projectile-resistant in a particularly preferred embodiment, constitutes the closure means 22 and is mounted within the vertical door frame member 23. It will be obvious that the closure 22 or as shown in some embodiments as 22*a* may be opaque, or impervious to light as well; that, although significantly less preferred, it may be hingedly connected to the booth; and include a latch securin and unsecuring mechanism and may be flat as well as rounded.

Figure 6:
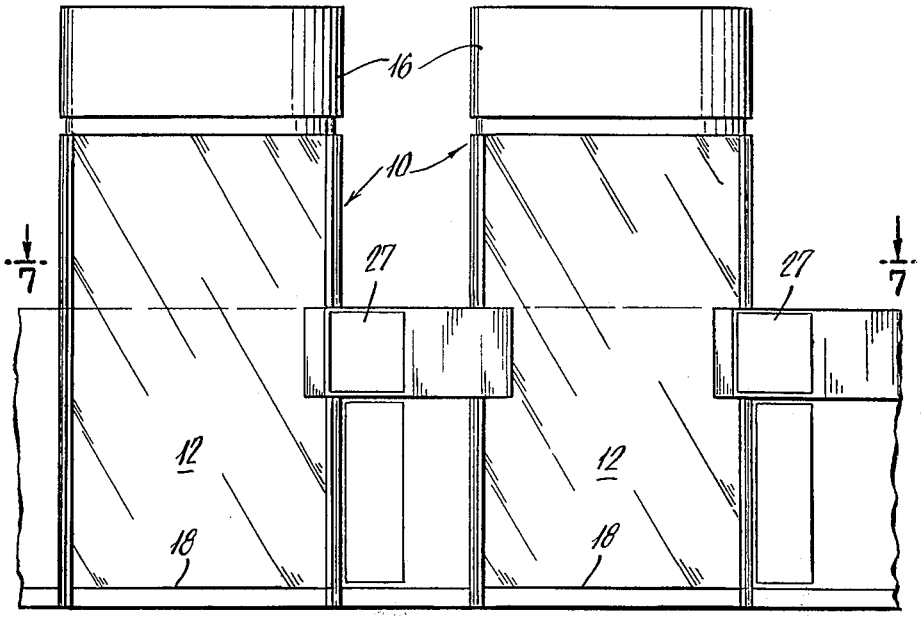
FIG. 6 is a side elevational view of a plurality of alternative booths embodying the invention.
Figure 7:
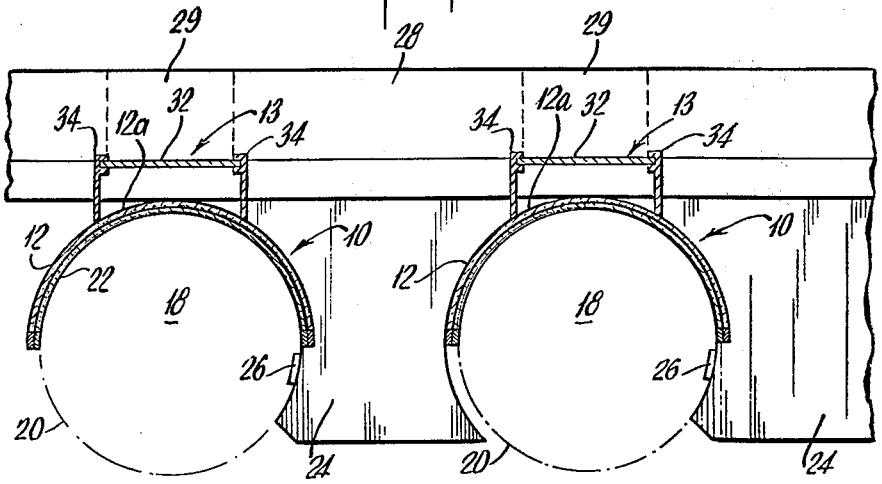
FIG. 7 is a horizontal sectional view of the booths shown in FIG. 6 taken along the lines 7—7 of FIG. 6.

A plurality of booths 10 are conveniently employed, particularly, as will be described hereinafter, in a facility for using in-doors such as shown in FIG. 6 and 7 with a filler panel 24 disposed between adjacent booths 10. Within the filler panel is mounted the drive motor (not shown) for operation of the closure means 22.

The closure means can be operated conveniently, for example, by a customer or other person within the booth by manipulation of the control panel 26 shown schematically in FIG. 1 to 5 and adapted to use in a similar manner in the booths of FIGS. 6 and 7. Access for servicing the control panel may, if desired, be effected from outside the booth by removal of the exterior cover 27 shown, illustratively, in FIG. 6.

As shown particularly in the embodiment of FIG. 7, the closure means 22 the designation or 22*a* serves the dual purpose of securing the interface 13 or entrance 20 as desired while simultaneously unsecuring the entrance 20 and interface 13 respectively. This means of effecting the practice of the invention is achieved with particular facility where the booth 10 is round in cross-section and the closure means 22 the expression or 22*a* has a breadth sufficient to close and secure the transaction interface 13 when the interior of the booth as shown in FIG. 7 or a portion thereof as in FIGS. 9–12 is open to the exterior and to uncover the interface 13 when the entrance 20 is completely closed and secured by the closure means 22 or 22*a*. This closure means defines a semicircle of approximately 180°, as shown in FIG. 7 and FIGS. 9–12, to accomplish this objective with the entrance 20 and interface similarly removed from one another by 180°.

It will be evident that by restricting the lateral margins of the interface and entrance, and, alternatively or additionally, placing the interface and entrance closer to each other about the periphery of the booth, the lateral breadth of the closure means may be diminished without adversely affecting its ability to accomplish its purpose as described hereinabove.

Figure 8:
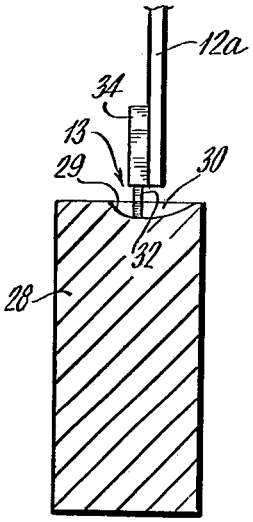
FIG. 8 is a side sectional view of a modification of a pass-through orifice and closure device for incorporation in the transactional interface of the booths of FIGS. 1 to 4.

The booth 10 may abut the teller counter 28, as shown particularly in FIG. 7, or, as shown in FIGS. 1 to 4 and 8 inclusive, partially overlay the counter 28. The transaction interface 13 comprises, illustratively, in either event, the pass-through orifice 29, which is of any conventional construction including, for example, a trough defined in the teller counter 28 through a cutout 30 in the interface panel 12*a*, as seen in FIG. 8, permitting the transaction of business between, illustratively, the teller, cashier or other custodial authority and the customer. This arrangement may be closed or open by any standard closure element such, for example, as the bullet-resistant shield 32. This latter element is secured in the paired vertically disposed guideways 34 mounted on the teller's side of the panel 12*a*. The sield may be raised or lowered in the manner of a guillotine and may be raised either manually or automatically, but securing and release of the shield is effected most desirably by means of the integrated electrical circuit control system provided according to the invention, as shown, illustratively, in FIGS. 20 and 21.

This securing and release mechanism integrates, as indicated, with the foregoing means for securing and releasing the closure means so that when in the embodiment of FIGS. 1 to 6, the closure means is open, the pass-through orifice 29 is closed and will be automatically secured in the closed position. When the closure means is secured, the pass-through orifice 29 is unsecured and open or, at least, may be opened manually to the extent necessary to permit transaction of business between, for example, the teller and customer.

Figure 5:
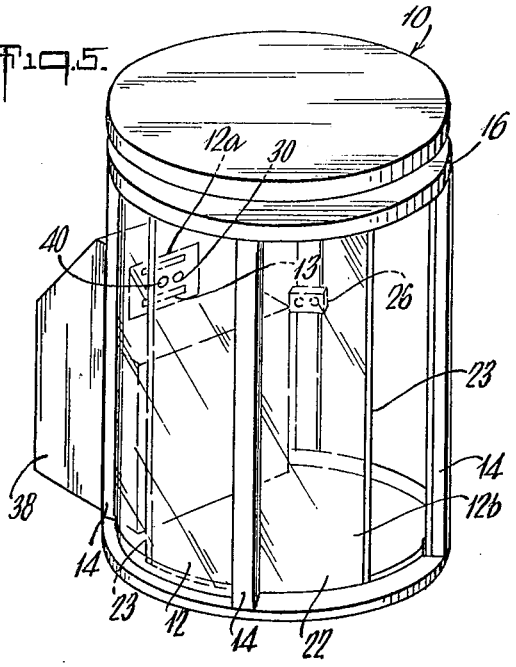
FIG. 5 is a perspctive view of the transaction security booth of FIGS. 1 to 4 adapted for use with a banking machine.

As shown in the embodiment of FIG. 5, the teller counter is replaced by an automated or automatic bank transaction machine 38 having its exchange unit 40 interposed in the cutout portion 30 of the panel 12*a*. If desired, the shield 32 may continue to be employed in this application to avoid tampering with the exchange unit 40 or the control circuit can simply provide alternatively or, in addition, for a complete shut-down of the exchange unit when the entrance is opened or entry or egress therethrough permitted as provided herein.

The foregoing transaction security system, according to the invention, can be modified in a variety of other ways as well as readily adapted, as noted hereinabove, for use, illustratively, in a banking application both out-of-doors and inside a banking facility. The out-door booth is that most fequently utilized in combination with automatic banking machines. Where the booth is to be used indoors, it is attached to the standard teller's counter 28, as shown in FIG. 1 to 4 in combination with the filler panel or exterior counter 24 of FIG. 6 and 7. A preferred embodiment of the invention for use with banking machines for reasons of increased security, mobility and most efficient use of space as described hereinafter is that in which the booth 10 encapsulates a secondary enclosure, a module, or transaction processing center wherein the banking machine is disposed.

With reference to the teller's counter 28, the trough 29 in the transactional interface may be a cylindrical turntable mechanism such as described in U.S. Pat. No. 3,702,101. Apparatus for enhancing or making possible audible communications may also be advantageously employed. A variety of conventional intercommunications systems mounted in a cutout (not shown) of the panel 12*a* of the transactional interface will serve this purpose. The voice boxes mounted as described in U.S. Pat. No. 3,298,329 are, for example, adequate.

It will be evident, as noted hereinabove, that the pass-through mechanism, whether of the trough or other variety is, in the preferred embodiment of the invention, capable of being closed so that the transactional surface presented to the customer in the booth 10 is a substantially uniform impenetrable bullet-resistant or bullet-proof interface. As described elsewhere herein, the closure means 22, is subject most desirably to control in conjuction with the securing and releasing mechanism so that the closure means 22 is secured in the closed position when the pass-through orifice is open or susceptible to being open and closed and secured when the closure means is open or susceptible to being opened.

As noted, the booth may assume any desired conformation; round, as in the drawings, oval, rectangular, triangular, hexagonal or square, by way of illustration, but with the inside dimensions, in a preferred embodiment, being so defined as to preclude occupation of the booth by more than one person. This objective can be accomplished conveniently, without engendering clustrophobia, by insertion of a shelf suitable for writing or holding packages about the booth interior of a sufficient width so that the booth walls are clearly remote from the booth's occupant.

The panels 12 (and 12*a*) of the booth, as well as the door 22, while bullet-resistant, are as indicated most desirably transparent and formed of glass or clear plastic for aesthetic effect and to discourge any sense of undesired isolation a customer may otherwise experience when detained in the secured booth. Further, of course, visibility facilities surveillance of the booth's occupant.*

* Alternatively, the foregoing panels may be so treated as to render them opaque to the exterior of the booth and transparent to the interior of the booth thereby providing privacy to the occupant while allowing him visual observation of his surroundings, a desirable feature where the booth is in a remote, exterior location. Provision of a communicaton means within the booth may be provided so that the occupant may obtain police protection before leving the booth should circumstances appear to require. The opaque and transparent properties of the panels may, of course, be reversed as well.

Also present in a further embodiment are one or more intake grills, so that the air can be drawn into the booth. A fan may be incorporated in the booth to encourage ventilation with exhaustion of warm air from the grill disposed in the booth ceiling 16 as well as a suitably sized air conditioning unit. The air-intake grill is generally positioned where present at the bottom of the closure means and has rigid bullet-resistant louvres on both the exterior and interior surfaces, pointed toward the floor in conventional manner to preclude the successful passage of a bullet outwardly from the booth interior.

Appropriate means may also be provided for covering the grills so that the interior of the booth, when invested with tear gas or other fluid designed to subdue the occupant of the booth, may be sealed temporarily if desired.

The closure means can also be modified, as indicated hereinabove, so that it is hingedly connected to the booth, mounted as a sliding panel descending from the ceiling, or, indeed, although generally less preferred, capable of rising from the floor of the entrance.

It is noted that the terms "closed," "secured," "locked" and "latched" have equivalent meanings, as do the terms "release," "unsecured," "unlocked," "unlatched," and "open," and their grammatical variations, in the context of the normal operation of the closure means 22, as shown in the accompanying drawings where securing the unsecuring of the various closure means of the embodiments 22, 22a, 22b and 22c is effected by a drive motor. This is true in the case of the transaction interface 13, as well, where a motor drive closure means serves both the interface 13 and the entrance 20. Where a latch release solenoid is employed, for example, rather than a drive motor the transaction interface may be unsecured or unlocked, but the actual opening of the interface is effected separately, as for example, by manually raising the shield 32 in FIG. 8.

This description is applicable, as well, to the closure means of the embodiments 22, 22*a*, 22*b* and 22*c* and the entrance 20. A latch release solenoid would be particularly useful for a hinged, unpowered closure means that could be forced manually particularly from the interior of the booth.

The base 18 of the booth 10 is normally and desirably bolted or otherwise fixedly secured to the floor of the bank or other transaction area in which it is located.

In a preferred embodiment of the present invention, the booth 10 incorporates a second enclosure or a plurality thereof as shown, by way of illustation, in FIGS. 9 to 12 inclusive wherein a plurality of interiorly disposed secondary enclosures 200 appear. These secondary protective enclosures or transaction processing centers are adapted to contain electronic data processing equipment, communications and automatic transaction or other transaction processing equipment including banking machines, associated vaults and the like requiring physical security and alternatively or, in addition, the maintenance of a specially and carefully sustained and controlled environment, as well as one which is provided with means to respond immediately to any departure from that control for whatever reason, such as fire detection and suppression and a small emergency power source if desired.

As shown in FIGS. 9 to 12 of the drawing, there is secured to the entrance frame element 23, as well as the booth ceiling 16 and floor 18 on each side of the entrance 20 and disposed at an angle to the circumference of the booth 10 and directed toward the interior of the booth, entryway panels 204 adapted to contact and be in registry with, along their inner vertical margins with the closure means 22*a*. The closure means is slidably mounted to move about a vertical axis parallel to that of the transaction security booth 10 between first and second positions; the diameter of the foregoing closure means 22*a* being substantially smaller than that of the outer enclosure housing 19.

Figure 9:
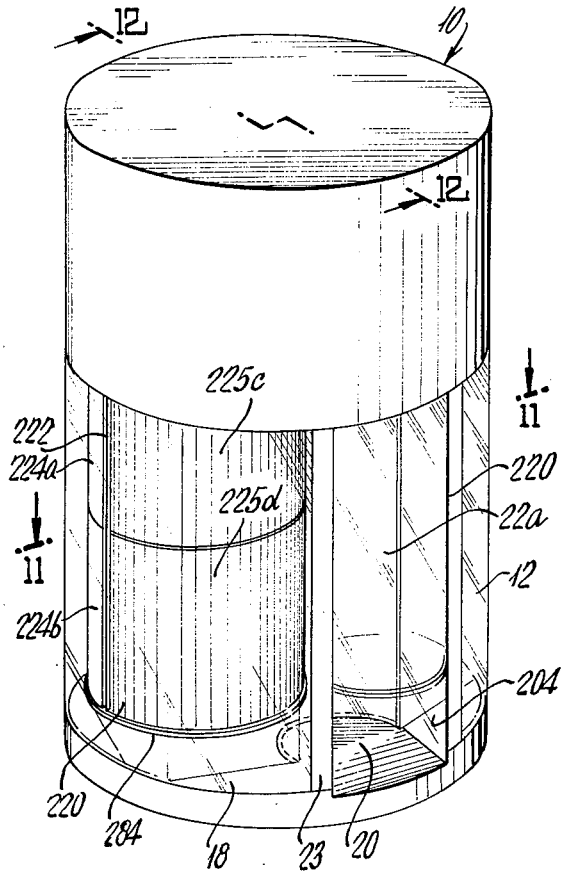
FIG. 9 is a perspective view of a transaction security booth and secondary enclosure transaction processing centers, disposed within the aforesaid booth, embodying the invention.
Figure 10:
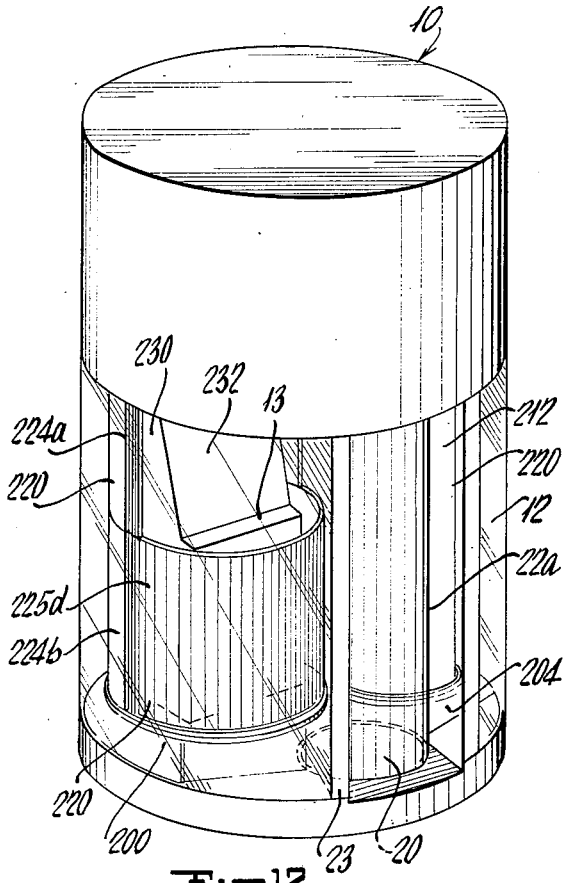
FIG. 10 is a further perspective view of the booth and processing centers of FIG. 9.
Figure 11:
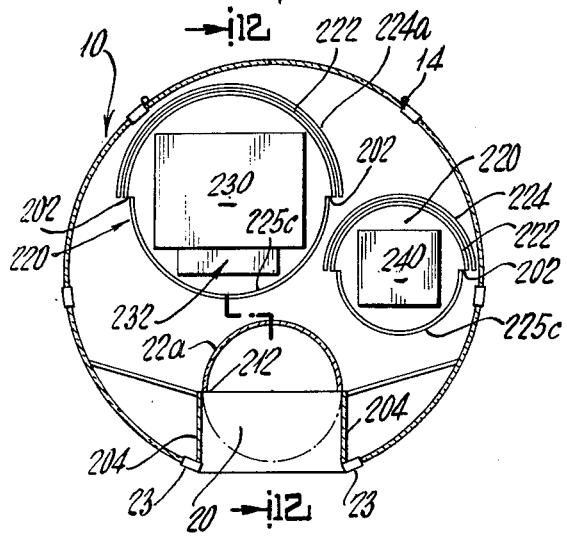
FIG. 11 is a horizontal sectional view of the transaction security booth and processing centers of FIG. 9 taken along the lines 11—11 of FIG. 9.

The closure means is acurately shaped in horizontal cross-section and moves between a first position in which the entrance 20 is open to occupancy as shown in FIG. 9 and a second position shown in FIG. 10 in which the entrance is closed, and access to the secondary enclosure 200 is provided. In order to prevent any marginal access to the secondary enclosure without complete occlusion of the entrance 20 during that period in which the closure means 22*a*, shown as semi-cylindrical in FIGS. 9 to 11, is moving from its first to second position, the closure means 22*a* need only be made to define an angle greater than 180° and less than 270° in horizontal cross-section. Advantageously, the plurality of closure means 22*b* and 22*c* may also be employed in the manner described hereinafter in connection with the embodiment of the invention shown in the FIGS. 18 and 19. It is also possible to reduce the distance between the entrance 20 and access to the secondary enclosure or module from 180°, and by increasing their proximity reduce the degree of arc defined by the closure means 22*a* as described with respect to the closure means 22 and the interface 13 appearing, for example, in FIG. 1 though 4.

Figure 12:
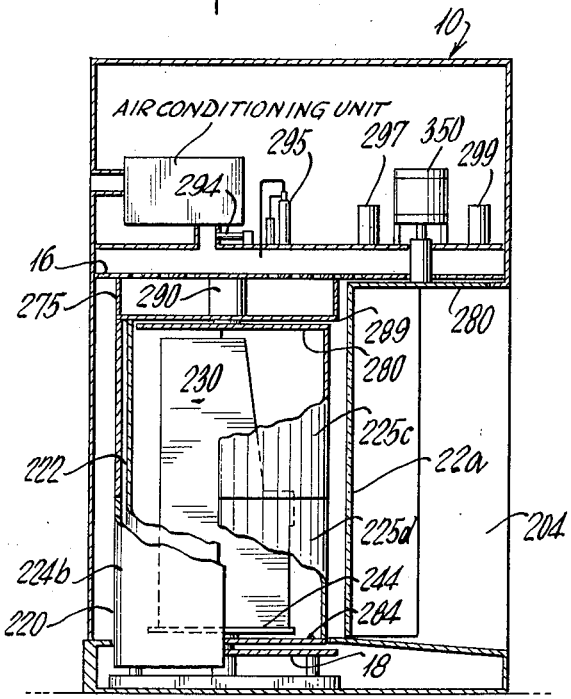
FIG. 12 is a vertical sectional view, partially in elevation, of the transaction security booth taken along the lines 12—12 of FIG. 9.

As shown in FIGS. 9 and 10, the lateral margins 212 of the closure means are in registry with the inner margins of the entryway panels 204 in the first (entrance open) position as well as in the second (entrance closed) position shown in FIG. 12. If more room is desired in the interior of the booth 10, the entryway panels 204 can be made to extend outwardly from the entrance frame elements 23 and the closure means moved outwardly as well with an extension or peak placed, when desired, in the relevant and proximate portion of the ceiling 16 to accommodate the arcuate shape of the closure means in the second position. A similar extension can be provided in the booth floor 18 where the latter is not in flush relationship with the floor surrounding the booth. Similarly, the foregoing peak is unnecessary where, for example, a hung ceiling is disposed in a like plane about the ceiling 16 of the booth 10. Alternatively, the closure means 22*b* and 22*c*, described hereinafter with respect to the embodiment of the invention appearing in FIGS. 18 and 19, can be substituted for the closure means 22*a* to materially reduce the cross-sectional diameter of the space otherwise required in the entrance 20 for effective operation of the closure means 22*a*.

The closure means is otherwise mounted and operated, and the entrance closed and opened, and secured and unsecured in the same manner as described elsewhere herein. The closure means 22*a* (or 22*b* and 22*c*), however mounted, is most desirably, of impact, and particularly, bullet-resistant contruction.

The secondary enclosures 200 are in a preferred embodiment adapted for use in cooperaton with the closure means 22*a* of the outer booth 10.

Figure 13:
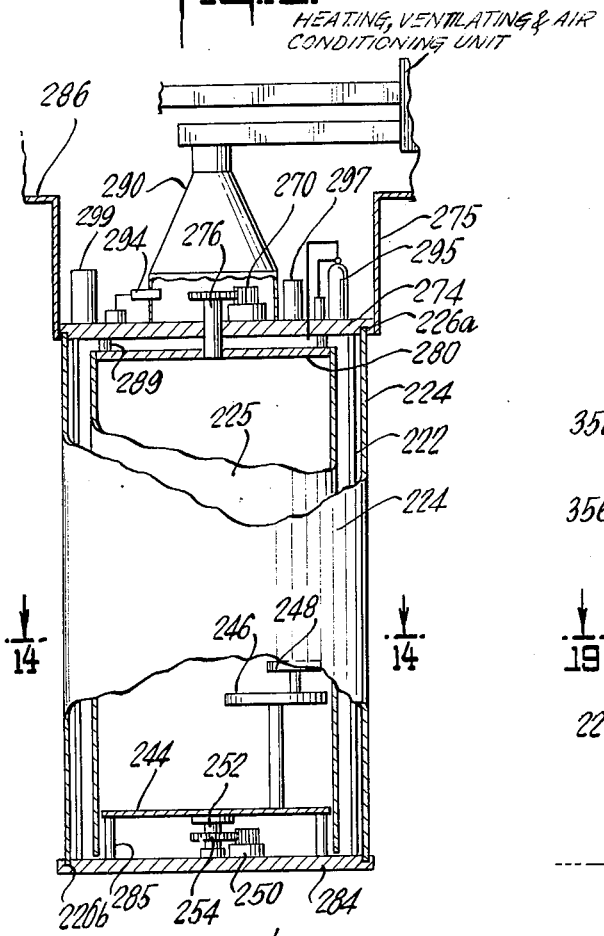
FIG. 13 is a broken side elevational view, with elements thereof depicted schematically, of an isolated transaction processing center or module modified for operation apart from the transaction security booth in which it is shown incorporated in FIGS. 9 to 12 in another embodiment of the invention.
Figure 14:
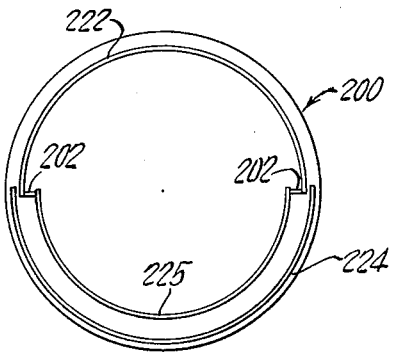
FIG. 14 is a horizontal sectional view, of the transaction processing center taken along the line 14—14 of FIG. 13.
Figure 15:
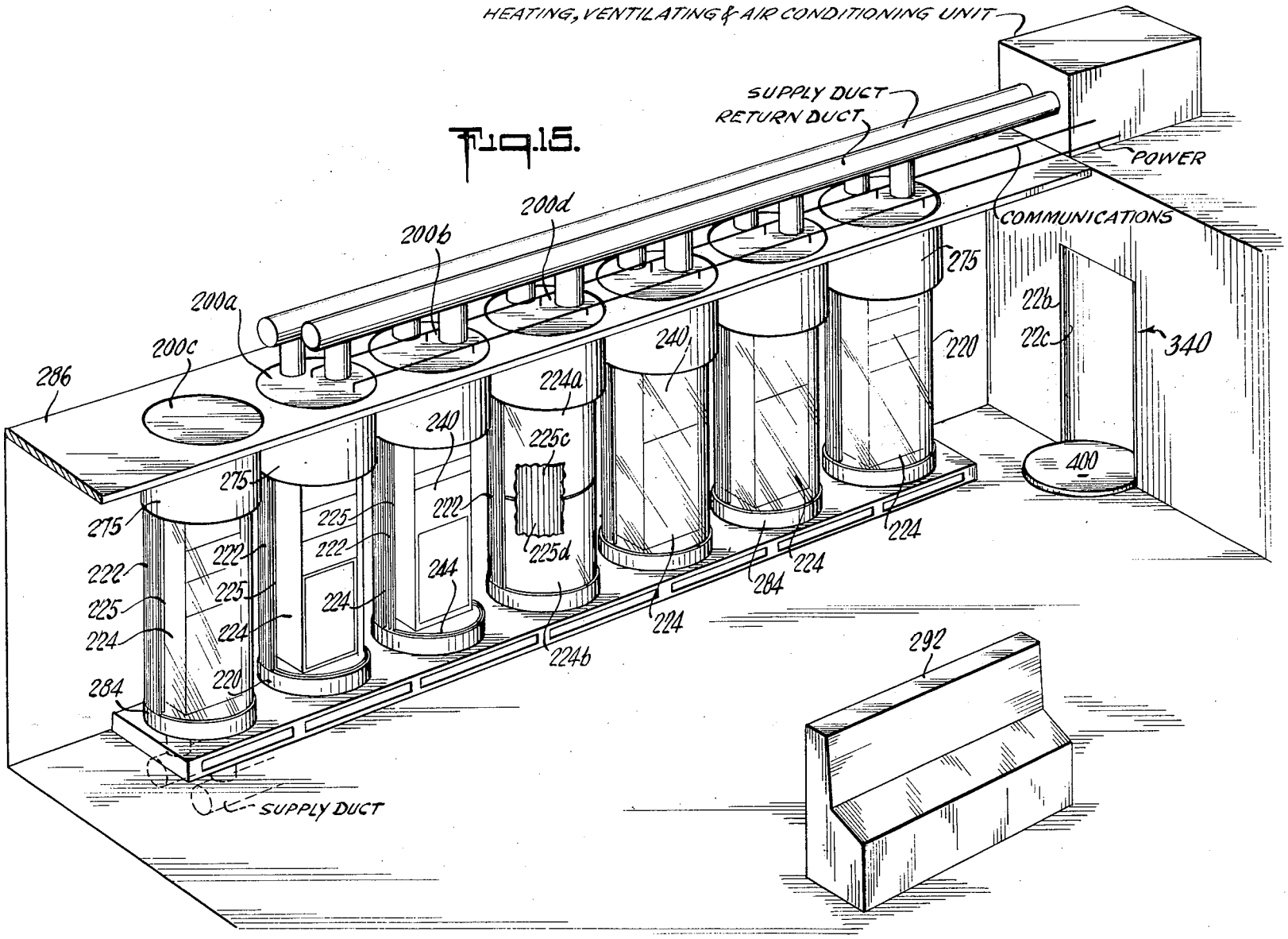
FIG. 15 is a partially broken perspective view of a plurality of transaction processing centers of the type described in FIG. 13 and 14, with some elements thereof shown schematically.

The secondary enclosures or transaction processing centers 200 of the type incorporated within the booth 10 are also utilized to particular advantage in the absence of the booth 10 as shown in FIGS. 13 to 15 and described in this context hereinafter.

A representative secondary enclosure or transaction processing center 200, with particular reference to the embodiments thereof disposed within the booth 10, comprises a housing 200, generally cylindrical in conformation, although a variety of shapes or combinations of shapes may be employed, composed of a stationary vertical wall 222 one or more access means and one or more slidably mounted arcuately rotatable secondary closure means, or second closure means 224, (and 225 where an additional inner second closure means is present), the lateral margins of which, in the closed position and thus occluding the access means are in registry with the rear wall 222. In the completely open position the second closure means 224 and 225 are preferably disposed respectively within and outside the wall 222, the second closure means 224 and 225 moving in a path defining an axis substantially identical to that of the arcuate wall 222. The stationary wall 222 and secondary closure means elements 224 and 225, in a preferred embodiment, define semicircles each of about 180° and, as is evident, provide the secondary enclosure or module in the closed state.

The housing 200 composed of its foregoing movable and stationary components may be formed of a variety of materials. Where a computer assembly is to be contained in the enclosures 200 one secondary closure means 224 is desirably formed of a transparent, impact-, and normally, a projectile-and bullet-, resistant material, and preferably in combination with a plurality of concentrically mounted secondary closure means 225, formed of a metallic material both fire and impact-resistant.

For convenience of reference where two concentric secondary closure means are used, the outer one is referred to herein by the designation 224 and the inner one by the reference 225. Where they are segmented horizontally, rizontally, they are referred to in this designation by their upper or lower disposition as 224*a*, the upper outer secondary closure means; 224*b*, the lower outer secondary closure means; 225*c*, the inner upper secondary closure means, and 225*d*, the inner lower secondary closure means.

Illustratively, as shown in FIGS. 13 to 15 and outer closure means 224, formed of a transparent impact-(e.g. bullet-or projectile-) resistant material is mounted conveniently on a track 226*a* formed on the perimeter of the upper module partition 274 and, additionally or alternatively, (shown as 226*b*) in the perimeter of the module base 284 to enclose or provide access to the housed equipment 230. A secondary closure means 225 is disposed within the outer secondary closure means 224 and formed of steel or other appropriate protective material. In the closed state these secondary closure means are in registry at their lateral borders with the stationary wall 222 by means of closure plates 202. The secondary closure means 225 when opaque, as is normally the case, may also be segmented horizontally and the upper component thereof 225*c* moved to the open state to expose or at least render visible through the outer secondary closure means, 224 or 224*a*, the equipment face and its operation. The foregoing embodiments can be employed where the module 200 is utilized within the booth 10 as well as where the module is a free standing unit as shown in FIGS. 13 to 15 inclusive. Where employed to house a bank transaction processing device such as automatic paying or receiving machines the movable and stationary portions of the secondary enclosure or module 200 must comply with the burglary-resistant material for such machines including the use of ⅜ inch thick nickel stainless steel meeting ASTM Designation A 16770, or such equivalent materials authorized, or as may otherwise be authorized hereinafter from time to time by the Board of Governors of the Federal Reserve System or other appropriate authority.

Where employed to house an automatic banking machine, the vault thereof will ordinarily be disposed under the transaction face 232 of the automatic banking machine 230. In this event, as shown in FIGS. 9, 10 and 12, the outer and inner secondary closure means 224 and 225 respectively, which may otherwise be single units, are horizontally segmented to provide two separately rotatable components, an outer upper component 224*a* (shown in FIGS. 9 and 12) and an outer lower component 224*b* and an inner upper component 225*c* and inner lower component 225*d* of approximately equivalent vertical as well as identical lateral dimensions. The upper secondary closure means 224*a* and 225*c* may be permitted to remain open during banking hours, for example, and closed at other times, or adapted to open when the first or other booth closure means 22*a* passes from the first to the second position.

Alternatively, where access is desired for servicing of the machine or vault positioned under the automatic teller or banking machine face 232, shown schematically, the lower secondary closure means 224*b* and 225*d* are rotated alone or in conjunction with the upper secondary closure means 224*a* and 225*c* and preferably in conjunction, too, with the closure of the entrance to the booth exterior by rotation of the closure means 22*a* to the second position so that the serviceman, by way of illustration, or other authorized person, can have access to the vault from the protected enclosure of the booth 10.

In the preferred embodiment of the booth as shown, particularly, in FIGS. 9, 10, 11 and 12, a second secondary enclosure module or transaction processing center also designated 220, may be present and adapted to incorporate accessory electronic data processing equipment 240 necessary to the operation of the banking machine. Its housing may, where required, be formed of similar material to that of the first module described hereinabove or formed of an impact and fire resistant material. The housing 220 of the latter module is similar in conformation and is composed of a stationary wall 222 and one or more access means with secondary closure means. In this instance, however, the secondary closure means 224 (and 225 where the inner element is present) are not so desirably segmented, ordinarily, but integral since access is not normally required by different classes of personnel for whom the illustrative banking machine 230 is provided in the first module. The secondary closure means can, of course, be segmented as well in this instance, if desired. Further, at least one movable secondary closure means 224 of the secondary enclosure module or transaction processing center 220 is desirably transparent for ease of observation of the operative data processing device 240 present therein without distrubing the environment in which it is maintained, as shown in FIGS. 13 through 15. A second secondary closure element or protective shield 225 located internally to the stationary wall 222 and made of an impact and fire-resistant material, such as metal, and generally opaque is often preferentially present as well with respect to this second module.

In any case, the transaction processing center 200, whether the first or second, as described above, further comprises turntable means, plate or platform 244 disposed in independently rotatable relationship with the housing 220 and disposed contiguously within the periphery thereof in a preferred embodiment. As will be evident in this context, the turntable 244 is essentially flat, may have other supplemental turntables 246 and 248 independently superimposed within the housing 220 as shown in the free-standing embodiment of FIG. 13 and is round or circular in horizontal conformation. The internally disposed secondary closure means 225 and the sum of any horizontally segmented subdivisional thereof 225*c* and 225*d*, such as seen in FIG. 15, will normally terminate below the periphery of the platform as shown in FIG. 13 at its lower margin and in the outer margin of the rotation plate 280 with which it is in fixed engagement at its upper end. Where a banking machine such as an automatic paying or receiving machine is enclosed within the module the inner secondary closure means or access element 225 will extend preferably from the upper module partition 274 by means of a flange 289 to the base 284 to comply with the requirements of the Federal Reserve Roard as expressed, for example, in Regulation P.

The turntable provides easy access to the rear or any other aspect of the transaction processing machine or electronic data processing apparatus present in the module for servicing or the like at the same site through the same access element used for all other purposes; accomplishing an economy of function and utilization of space unknown heretofore. Its rotation can be integrated selectively through a standard control panel (not shown) with opening of one or all segments of the secondary closure means and with closure to the exterior by the closure means 22*a*.

All of the functions thus far described as well as securing or latching and unlatching of the booth or module are accomplished conveniently by means of conventional electrical circuitry well known to one skilled in the art. The control means is similar to that described with respect to the other apparatus and, illustatively, the booth 10 of FIG. 1 to 4.

The turntable is, in any event, conveniently and independently controlled by operation of a drive motor 250 and drive shaft 252 interconnected through a standard system of bevelled gears 254; the drive shaft being mounted on the undersurface of the turntable 244 at its axis of rotation as illustrated in the free-standing module of FIG. 13. Alternatively, the rotation of the turntable may be accomplished by a variety of mechanical means obvious to those skilled in the art or, indeed, although significantly less preferred, by manual means. The position of the turntable may be fixed by an externally operated brake or locking mechanism on the drive shaft 252 (not shown).

A similar drive mechanism 270 is mounted atop the upper module partition 274 disposed within the supra module housing 275 as shown in FIG. 13 by means of the rotatable shaft 276 which extends through said partition 274 in which it is independently rotatably mounted by means of a bearing assembly (not shown) to terminate in the axis of the circular horizontally disposed upper module or rotation plate 280 which is in fixed engagement with said shaft 276 and rotated thereby. The inner protective secondary closure means 225 of the module 200 is preferably in contiguous contact or registry with the periphery of the rotatable upper module plate 280, as noted hereinabove, and may be operated manually as well as mechanically. When inner secondary closure means 225 are divided horizontally into 225*c* and 225*d*, respectively, the support and drive mechanism for 225*c* shall be identical to that described hereinabove for 225 as a single unit. The support and drive mechanism for 225*d* shall consist of an arcuate track on the base 284, of generally circular shape with internal drive ring (not shown) and, a drive motor (not shown); alternatively, a variety of methods can be employed as is obvious to one skilled in the art. Of course, manual operation in conjunction with an electrical control means or as an over-ride method of operation of said secondary closure means in event of failure of said drive mechanism is also an alternative, but is less preferred. While described with respect to the inner secondary closure means 225, it will be evident that the outer closure means 224 can be similarly segmented and the modes of operation enunciated hereinabove with respect to the inner secondary closure means 225 applied to the outer secondary closure means as well. The lateral margins of said secondary closure means 225 will be made registrable with the stationary wall 222 in the open state and its lower edges with the base 284 in a preferred embodiment as also described hereinabove. The upper margins may also be in registry with the supra module partition 274 through the extended closure flange 289, as also earlier described hereinabove. The stationary wall 222 is, in turn, secured within the outer margin of the upper or supra module partition 274 exterior to the outer periphery of the plate 280 and extends to the floor or base 284 upon which the unit or module is located. As noted, the upper end of the rotatable protective secondary closure means 225 is, in a preferred embodiment, in contiguous, slidable and sealed relationship by means of the flange 289 with the upper module partition 274 and it is where the module serves to encapsulate a banking machine, particularly, that the lower end thereof is in like engagement with the base 284 of the module as also described above. The secondary closure means 224 and 225 may also be segmented vertically, but this alternative is normally significantly less preferred.

Rotation guide means composed of struts 285 serve to support the turnable or platform 244. These guides may be telescoped and thus extensible to support the platform or turntable 244 at any desired level above the module base 284 and, of course, under the partition 274. At the same time, the flange 289 serves to level, in a similar manner, the rotation plate of the inner secondary closure means 225.

In accordance further with the practice of the invention, the system thus described may also be responsive to an alarm and over-ride control in the manner generally of that described elsewhere herein with respect to the booth of FIGS. 1 to 4 so that in response to seismic shock from a physical attack or unauthorized or unprogrammed attempt to gain access thereto, experienced by, for example, the banking machine as the result of attempted burglary or other tampering, the inner secondary closure means 225 or its components 225(*c*) or 225(*d*) will close while the closure means 22(*a*) will be retained in place securing the miscreant within the booth 10 in one preferred embodiment.

With continued reference to the secondary enclosure or transaction processing module or center 220, and more particularly, to the free-standing manifestation or embodiment of FIGS. 13 through 15 it will be seen that the upper or supra module housing 275 is continuous with or defines entry into a hung ceiling 286, which contains, as shown diagrammatically in FIGS. 13 and 15, the conventional heat, ventilation and air-conditioning systems as well as electrical and communication lines into which the module may be grafted to provide, where electronic data processing units are encapsulated by the module, for example, the controlled environment necessary to its operation. The riser duct 290 serves to effect transmission of the foregoing environmental components to the interior of the module 200 in the embodiment of FIG. 13. The support members 14 shown, for example, in FIG. 1 where employed in the stationary wall of the second enclosure or transaction processing center as well as the outer booth may be integrated with the riser duct 290 for the purpose of transmitting the flow of gaseous components through the enclosure. To effect this transmission, the upper module partition 274 is perforated (not shown). Also perforated (but not shown in the drawing) are the turntable 244 and upper rotatable module plate 280 to assure access and even distribution of the foregoing atmospheric environmental components within the module. It is also within the contemplation of this invention that a duct similar to the foregoing may transmit in like manner from the heat, ventilation and air-conditioning system of the floor below that on which the module is located as illustrated semi-diagrammatically in FIG. 15 through the module base 284. It is also consistent with the foregoing description that individual units suitable for securing the necessary atmospheric control be placed within the supra module housing 275 for delivery to the module interior or chamber wherein the apparatus 230 is located. Means of fire detection 294, fire suppression 295, and motor control unit 297 and a source of emergency power 299 for these systems are placed in the supra modular housing as shown diagrammatically in FIG. 13 without affecting materially the ease of assembly, disassembly or mobility of the module 200. These means are also utilized in the transaction security booth of FIGS. 9 to 12 hereinabove. Alternatively, these elements may be located on the base 284 or the module 200 or under the floor 18 of the booth 10 and respectively, below the turntable of said module 200 or under a raised or flooring system in said booth 10.

A plurality of free-standing (that is free-standing in terms of the absence of any surrounding booth (10) structure) transaction processing center integrating for purposes of illustration with a hung ceiling above, or alternatively, one below or a combination thereof are shown in FIG. 15. The transaction processing centers include the supra module housing 275, a stationary wall or housing 222, an access element and the secondary closure means or shield 224 of a transparent character so that the operator of the computer apparatus 230 incorporated in the modules 200, and shown schematically in FIG. 15, may observe their performance without opening the secondary closure means 224 in each instance while stationed at the console 292. However, a second inner (or outer) reinforcing protective secondary closure means 225, as noted hereinabove, composed, illustratively, of fire resistant and impact-resistant material, such as steel or the like, and thus normally opaque may be used to guard the access opening, generally remaining open and retracted within the housing as shown, illustratively, in the module 200(*c*) of FIG. 15. The normally light transparent outer concentrically disposed secondary closure means 224, as noted elsewhere herein, serves to protect the environment primarily within the module 200 while permitting observation of the housed equipment during use. The opaque closure means 225 may be closed when the data processing equipment is or is not in operation or may be automatically closed in the event of fire, flood, or attempted vandalism or inappropriate use of the housed equipment.

As illustrated further by module 200(*a*) of FIG. 15, the transparent secondary closure means 224 is closed to maintain a controlled environment in the module. In module 200(*b*) of FIG. 15 the outer transparent closure means 224 as well as the internal protective closure means 225, are shown in the open state with the rear of the data processing equipment 240 exposed, having been rotated on the turntable 244 for servicing. Module 200(*c*) of this same drawing is identical in the operative state it presents to that of the module 200(*a*). Module 200(*d*) is shown with both the outer secondary and inner closure means and their segmented components, 224*a*, 224*b* 225*c* and 225*d* in the closed state.

A particular advantage of the present invention is apparent from the embodiment of FIG. 15 in that, as shown, the entire environment of the room in which the transaction processing centers are disposed need not be subject to the rigorous controlled conditions required within the transaction processing centers where electronic data processing equipment is housed. Ingress and egress from the computer-containing room can take place freely and yet each module is also protected against vandalism, each secondary closure means 224 being subject to latching in the manner of the booth 10 as described elsewhere herein. At the same time any desired piece of electronic data processing equipment can be readily removed from its identical location with its module and installed immediately, and normally, elsewhere by "plugging" into existing heat, ventilation and air-conditioning lines.

An extensible ramp may be employed for installation and removal of any data or transaction processing equipment from a module or booth where the turntable upon which the equipment is placed is above the level of the floor.

Figure 16:
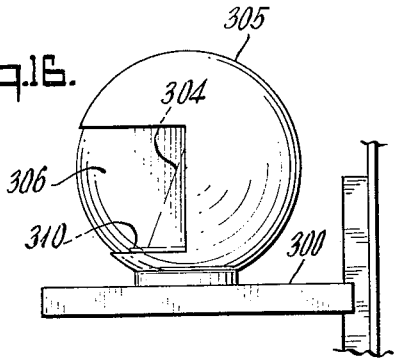
FIG. 16 is a side elevational view of an alternative embodiment of a transaction processing center or module such as shown in FIGS. 13, 14 and 15 adapted to accommodate instrumentation of reduced dimensions.
Figure 17:
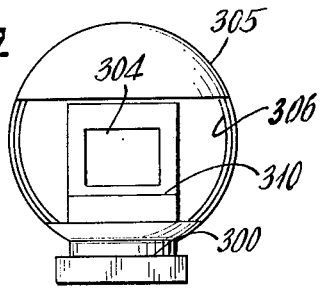
FIG. 17 is a front elevational view of the apparatus shown in FIG. 16.

FIGS. 16 and 17 of the drawing show a protective housing 300 for use with more diminutive apparatus than that contemplated hereinabove. Illustrative of such equipment would be a table-top computer terminal or microcomputer 304 indicated diagrammaticaly in the aforesaid FIGS. 16 and 17. The housing is composed of a protective stationary wall 305, a secondary closure means 306 (shown in the closed state of FIG. 16 and in the open state in FIG. 17) preferably an opaque metallic protective shield rotatable about a common verical axis with that of the stationary housing 305. The rotatable secondary closure means or access element 306 is slidably movable about the foregoing axis and is mounted for such movement in the manner described with respect to the secondary closure means 225 of the transaction processing center 200 discussed hereinabove. Similarly, the housed equipment 304 is mounted on a turntable 310. Further, means of ventilation, such as a blower assembly, a fire detection element, a fire suppression device and devices (not shown) designed to detect any attempted damage or misuse of the enclosed equipment may also be present within the housing or enclosure 300 and provided in a manner described with respect to FIGS. 13 to 15.

The secondary closure means 306 may be mounted so as to revolve about a horizontal or intermediate axis between the horizontal and vertical planes as well. The general shape of the enclosure is shown to be spherical in the preferred embodiment of FIGS. 16 and 17. It is appreciated, in any event, that a variety of shapes can be utilized in defining the configuration of the enclosure 300 and that the configuration of the stationary wall 305, e.g. spherical and the secondary closure means 306, e.g. hemispherical, will depend in large measure on the shape of the computer terminal or micro-computer 304 enclosed. The drive element of the secondary closure means 306 can contain a slip clutch to stop arcuate motion of the secondary closure means or shield 306 when its path is obstructed. Detection elements may also be placed along the margins of the secondary closure means 306 to operate so that objects disposed in the path of movement of the secondary closure means 306 will cause a temporary cessation in movement of the secondary closure means until removal of the unwanted objects is effected. Advantageously, the enclosure 300 may be mounted on a counter to desk top or at any other adjustable height suporting surface.

Figure 18:
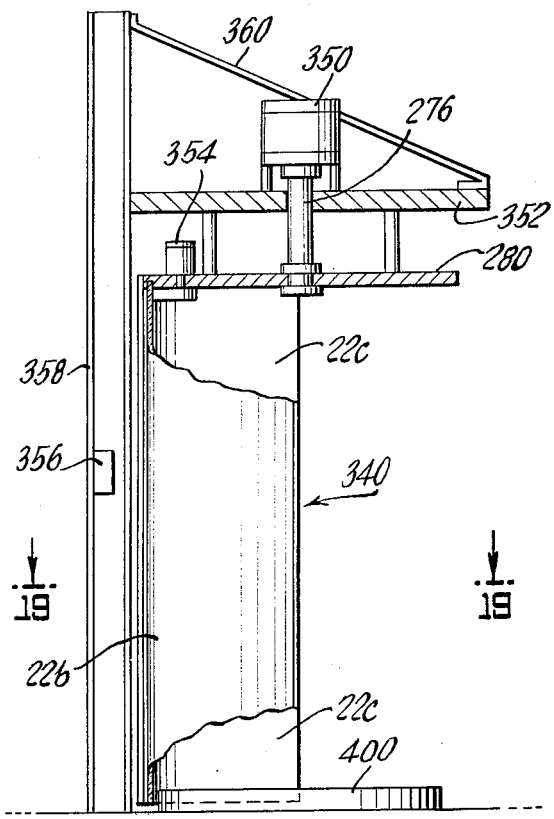
FIG. 18 is a vertical sectional view, partially in elevation, of closure means for use independently to provide a security passage system or unit which may also be used in the booths and enclosures according to the invention.
Figure 19:
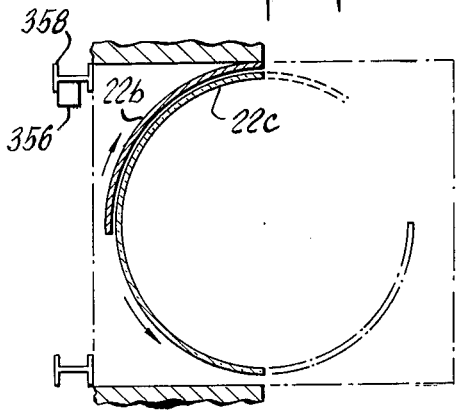
FIG. 19 is a sectional view of the passage security unit taken along the lines 19—19 of FIG. 18.

Reference is now made to FIGS. 18 and 19, the operation of which utilizes closure means 22*b* and 22*c* which serve as an alternative for use in the booth 10 alone or in conjunction with the module 200 or the other embodiments of the invention disclosed herein. As shown in FIG. 18 and 19 this apparatus may serve as a personnel entry interface unit 340 for controlled entry of persons into areas requiring, for example, a security check or clearance and as means to protect the secured area from direct exposure to the external environment.

The assembly as so constructed, and shown in FIGS. 18 and 19, comprises a closure means composed of two arcuate shields 22*b* and 22*c* which are operative independently, but relative to one another, moving in a circular path about a common axis. While concentrically disposed, the lateral margin of one shield will be in registry with, and abut, the other, when they occupy complementary portions of the cylindrical path about which they travel. While both vertical shields may be semmicircular in horizontal section; in a preferred embodiment the two will differ in the extent of the cylindrical perimeter they occupy. Thus, the inner primary revolving shield 22c will define an arc of about or precisely 180°. The outer or secondary or revolving shield 22b will encompass an arc of from in excess of 90° to 180°. The smaller end of this latter range is generally preferred since a secondary shield 22b of this dimension while accomplishing the objectives for which it is utilized permits these objectives such as surveillance and security clearance, and protection of the secured area to be accomplished employing, suprisingly, a significantly smaller cross-sectional area than where, for example, a single shield of 270° is utilized. The inner shield 22c is mounted in fixed engagment at its upper end with the rotation plate 280. The rotation plate 280 is affixed at its axis to the vertically disposed rotatable support and drive shaft 276 which is connected in turn to the motor and drive assembly 350 and is secured to the support plate 352 by a conventional bearing assembly (not shown). The outer or secondary shield 22b defining an arc of 90° to 180°, as noted, is mounted for cooperative but independent movement in a conventional drive ring assembly slidably mounted about the periphery of the rotation plate and is driven in turn, and separately from the drive assembly 350, by a second drive assembly 354 which, while energized electrically in a preferred embodiment may be mechanical, pneumatic-piston, electrical or the like. This latter drive assembly 354 is mounted eccentrically on the rotation plate 280 in cooperation with the drive shaft 276. Control of the first and second drive assemblies or mechanism 350 and 354 respectively is through a detection mechanism 356 on one of the two support girders 358 of the assembly and the drive assembly 354 and unit 356 are connected for interaction as described by conventional electrical control means. The support girders 358 maintain the stability of the assembly by engaging the lateral margin of the support plate 354 and by means of the struts 360 extending from each of the support girders 358 to the opposite margins of the aforesaid plate 360.

The closure means 22b and 22c in operation move between three primary positions, returning to the first of these positions upon completion of a cycle. Thus, one seeking access to a booth (or a computer room such as shown in FIG. 15 or indeed along a corridor, using the unit 340, will find the passage occluded and enter, for example, into the perimeter of the unit defined by the path of rotation of the shields 22b and 22cwherein or in proximity thereto provision is made for identification such as by use of a personnel identification card, or alternatively or in addition, by stepping on a pressure sensitive mat 400 normally responsive to only a single identified person, or employing other conventional means of activation common to security clearance. However effected, the patron or occupant of the foregoing perimeter will be facing the inner 180° arcuate shield 22c which will define a concavity to the booth occupant. Arrayed concentrically behind it is the preferably smaller outer shield 22b. This is the first position referred to above. Activation of the unit 340 once accomplished as, for example, through the detector control mechanism 356 causes the inner shield 22c to rotate in a direction which is opposite to that of the outer shield 22b. The relative directions as shown in FIG. 19 are counterclockwise for the inner shield 22c and clockwise for the outer shield. It will be obvious that these directions may be reversed within the contemplation of the invention and that the relative inner and outer disposition of the shields can also be altered, although the relationship defined, for example, in FIG. 19 is a preferred embodiment.

Initially, in achieving the second position referred to hereinabove by virtue of its disposition in ring drive assembly to the rotation plate 280 the outer shield 22b may be said to move in a clockwise manner although it simply stays in place while the inner shield 22c moves in a counterclockwise manner driven by the rotating plate 280 and its motor drive assembly to that point at which one lateral margin of each of the two shields is in registry with the other and the perimeter occupied by the shields is the sum of the arcs defined by the two shields individually. In this position entry into the interior of the booth 10 or the room appearing in FIG. 15 or other passage means or secondary enclosure or module 200 remains impeded and egress into the area from which entry into the perimeter was secured is materially decreased or eliminated depending upon the arc defined by the outer shield 22b. The shields then continue, in effect, their clockwise and counterclockwise advance to the third and final position in the sequence in which the two shields are again arrayed concentrically, but this time across that portion of the perimeter from which entry was intitially made; the shield 22c completely occluding this portion of the perimeter with the outer shield disposed behind it. The opposite side of the perimeter is in the third position open and unimpeded to the occupant of the interior of said perimeter and when he has moved forward out of the perimeter the detector means 356 will cause the shields to reverse direction and return to their first position. The passage through the three foregoing positions is a continuous one which abets significantly the use of an outer shield of reduced arcuate scope in the practice of the invention. Although it is unlikely that a miscreant or vandal could gain acess to the enclosure as defined by the shields or closure means 22b and 22c in their unlapped state resulting from their arcuate motion in opposite directions, including that of the inner shield 22c alone, it would be possible for an individual, for example, to discharge a firearm or dischage a bomb or incendiary device into the enclosure when occupied by another if the outer or security shield does not describe an arc of greater than 90° as provided by this invention. To prevent injury to an authorized user of a booth or closure protected by the enclosure means 22b and 22c, the drive motors may be equipped with slip clutches to temporarily suspend motion of said closure means if their pathways are blocked in which event the control means most desirably will return the shields to the foregoing first position. Similarly, slidable detection elements may be mounted at the edges of the shields 22b and 22c on tracks placed on slide closure means to electrically communicate with the control means, 356, so that if deflected by an object in their path, the motion of the closure means may be temporarily halted until such obstruction is removed or preferably reversed.

Securing of the entrance or interface and release of the interface or entry, respectively, in the booth of FIGS. 1 to 5 is effected according to the invention, most desirably and uniquely, by means of an electrical circuit.

Regardless of the particular apparatus employed; whether the booths are those embodied, for example, in the foregoing FIGS. 1 to 4 or in FIGS. 6 and 7 or that employed with a banking machine as in FIG. 5, or that exemplified in FIGS. 9 to 12, it will be evident, in this context, that the circuitry required with particular reference to FIGS. 6 and 7 will be of reduced complexity where control of the closure means 22 effects closure and release of both the transaction interface and entrance simultaneously and an assembly such as shown in FIG. 8 or the secondary enclosures of FIGS. 9 to 12 are omitted. This ommission results however, in a substantial disadvantage in that both the interface and entry cannot be secured in the closed position simultaneously when the alarm over-ride is exercised as described hereinafter.

Figure 20:
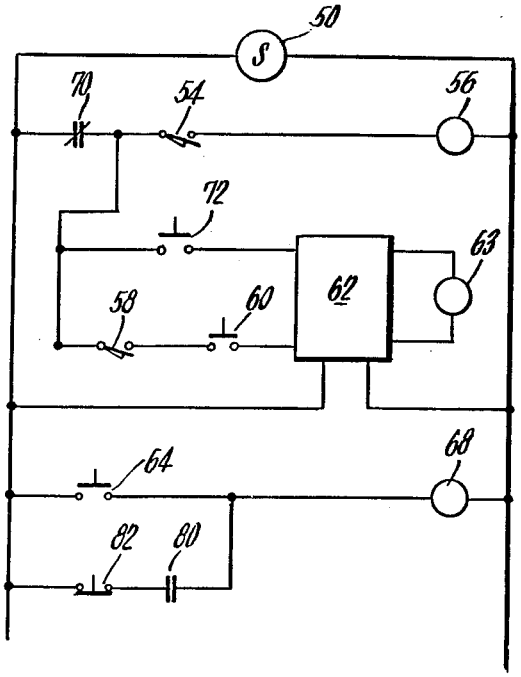
FIG. 20 is a schematic diagram of a typical electrical circuit for use in controlling the activation and deactivation of the closure means and transaction interface panel in the transaction security booth of the invention, together with an over-ride control circuit means.

FIG. 20 is a simplified schematic diagram of normal electrical control circuit means for securing and releasing the door in cooperation with the transactional interface. Also included is an electrical circuit means for additionally over-riding said normal securing and release means of the closure means or elements of the transactional interface and entrance in accordance with the invention as embodied, illustratively, in FIGS. 1 to 8.

The system thus includes a door control mechanism for a booth 10 for normal operation with an over-ride control which may be used, for example, at the discretion of the teller or other human custodial agency within the bank.

The over-ride control and alarm means, when triggered, prevents the door or closure means 22 from opening. Authorities, remote from the booth, may also be alerted by an audible alarm or light on the outside of the booth and integrated into the over-ride circuit. The invention has the peculiar advantage, in this respect, of permitting apprehension of the felon at the immediate site of his criminal endeavor, a uniquely desirable posture from the point of view of the putative victim and prosecuting authority. The power source 50 is connected through the normally closed contacts 70 of the alarm relay 68 and the close door switch 72 to the reversing motor controller 62. When this switch 72 is closed, it causes the closure means 22 to close and become secured either inherently by the use of a worm gear drive (not shown) discussed hereinabove or else by an independent latch (not shown). When the closure means 22 is closed it causes the door closed switch 54 to close thus energizing the transaction initiate solenoid 56. This solenoid unlocks the transaction interface 13, or if desired, opens it.

When the transaction across the interface is completed by the customer in cooperation with a transaction processing machine or a teller, for example, the transaction complete switch 58 is activated by the teller closing the interface 13. Where a banking machine 38 is substituted for the the teller, the switch 58 is activated by the banking machine enabling the door open switch 60 to unsecure the closure means 22 and, simultaneously, open the door closed switch 54, thus deactivating the transaction initiate solenoid and securing the interface 13 by a spring return on the solenoid. It will be evident to one skilled in the art that any action referred to as being taken by a teller in this description can be affected by a transaction processing machine or apparatus acting in concert therewith. The cycle can be so adjusted too that there is, if desired, a time lag of variable duration between securing of the interface and unsecuring of the door of closure means 22.

The securing and release means may be over-ridden by the alarm provision also contained in the circuit. When the alarm relay 68 is activated the normally closed contacts 70 of that relay open, causing the door open and close functions to be disabled. Although, as shown, the door 22 will either stop moving and simply remain in one position when the alarm is energized, provision may also be included to cause the door to close from whatever position it is in when the alarm is activated. The alarm relay 68 is activated by the closing of switch 64. Contacts 80 on the alarm relay are in turn closed which maintains the alarm condition until the switch 82 is pressed and the circuit is opened.

FIG. 20 may be modified to embody an alternative and less preferred form of the present invention. This latter modification involves the removal of the switch 54, the solenoid 56, and their interconnecting wire. As changed, the circuit retains the door open and door close functions along with the alarm over-ride. The customer's ability to leave is temporarily disabled during transactions by means of teller or automatic operation of the transaction complete switch 58.

Basic, in any event, to the preferred embodiment of the invention is cooperation between the door 22 and closure means and the transactional interface 13. The transactional interface is normally secured when it is in the closed position. It is unsecured by the condition of the door 22 being completely closed. When the door is released or opened, if desired, by any means the transactional interface is secured. Also, the teller controls which are normally used to unsecure, or open, the door are not operative unless the transactional interface is secured. This is achieved by embodying the transaction initiate switch in a form which registers the condition of the transactional interface 13. When the interface is closed the switch 58 is closed thus enabling the door controls. When the interface is open so is the switch 58 and the controls are disabled.

The foregoing operation is described generally in terms of a teller-operated booth, but it will be obvious as indicated in the description appearing hereinabove to one skilled in the art that the security system described may function equally well where a bank transaction machine is substituted. In the latter event, the control means can can activate the transaction machine only when the door 22 is closd and secured, as noted above, replacing optionally the unsecuring, and if desired, elevation, of the shield 32 in one embodiment of the teller-operated interface.

Figure 21:
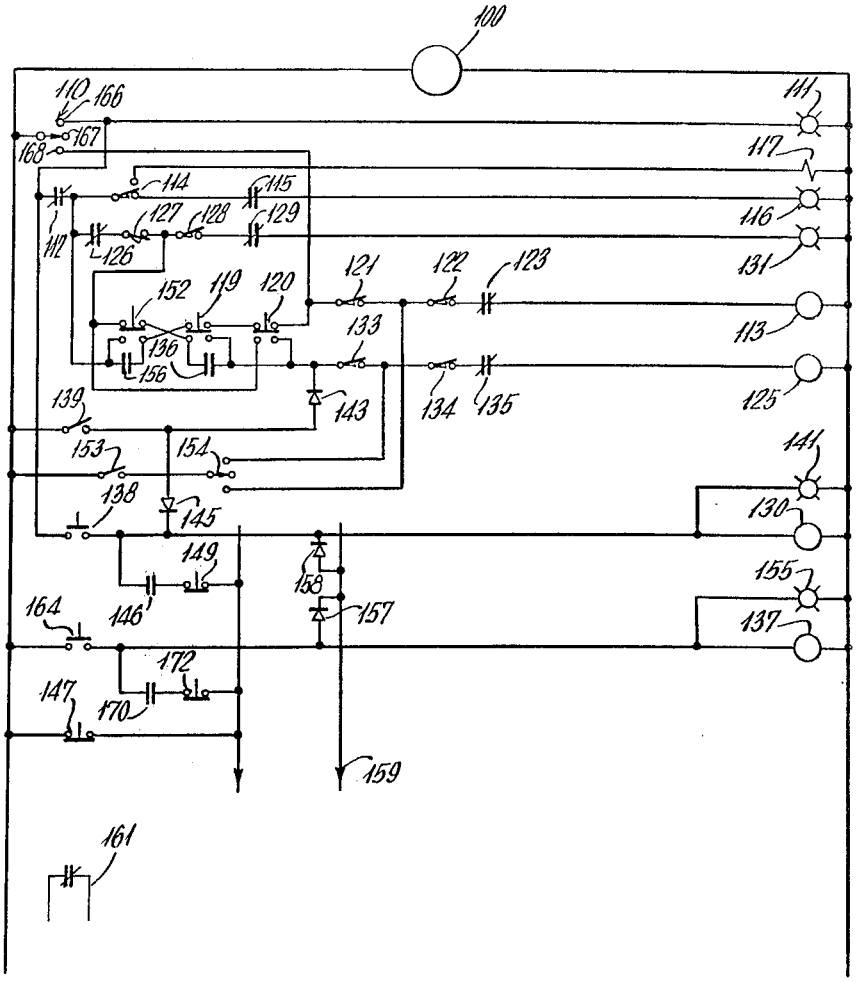
FIG. 21 is a schematic wiring diagram showing an electrical control circuit for use in a specific application of the apparatus of the invention.

A further and more detailed embodiment of the circuitry used to effect the foregoing, and other and additional objectives and advantages in accordance with the practice described herein is illustrated by the following description taken in conjunction with the wiring diagram of FIG. 21 wherein the control system, connected to a standard conventional direct current power supply 100, is placed in service, illustratively, by the teller, similar custodial agent or other agency activating the mode switch 110 to the "on" position. This step serves to energize the door control system and cause the booth "on" indicator 111 to light.

Depending on the position of the closure means or door 22 at this point, either or both of the open door and close door indicators, 131 and 116, respectively, will also be lit. If not fully open, for example, the teller or other agency may cause the door or closure means to be open by depressing the teller's open door push button 120 which will energize the open door relay 125 and the door drive motor 63 (shown diagrammtically in FIG. 20). When the door is fully open the booth is available for entry by the customer and the close door indicator 116 will be lit.

Upon entering the booth the customer shall, where a control panel is disposed within the booth as shown, for example, in FIGS. 1 to 8, depress the customer's close door push button 152 energizing the close relay 113 and the door or closure means drive motor 63 initiating the movement of the door or closure means 22 of FIGS. 1 to 8, for example, along the track (not shown) to the closed position. At this point, the open door indicator 131 will light providing the customer with notice of the incipient door closure. The customer can reverse the action of the closure means 22 by depressing the customer open door push button 119, if he elects not to stay in the booth and undertake any transaction across the interface 13. When the door is fully closed, close limit switch 114 will be activated energizing the pass-through solenoid 117 and permitting the shield 32, for example, of the transaction interface 13 to be opened, and if desired, activated to an open position. When the interface is open the interface limit switch 127 will be operated causing the open door indicator 131 to be extinguished and the open door push buttons 119 and 120 to be disabled. At this point a transaction can be effected across the interface.

Upon completion of the transaction and the closure of the interface the interface and pass-through limit switch 127 will be closed illuminating the open door indicators 131 and enabling the open door push buttons 119 and 120. The teller, customer or other agency can at this point in time initiate the open door function by depressing one of the open door buttons 119 or 120, which will serve to energize the open door relay 125 and the door drive motor 63 causing, in turn, the initiation in opening of the closure means 22. Opening of the door or closure means will not actually occur until the close limit switch 114 operates, to de-energize the transaction interface solenoid 117 latching the interface in the closed position, in the embodiment of FIG. 10. The close door indicator 116 is now lit and the customer may reverse the direction of the door by depressing the close door push button 152, if once again, he should change his mind and elect to undertake a further transaction across the interface. Contacts 136 and 156 are holding contacts on door open relay 125 and door close relay 113 which serve to keep the relays energized after the door open push buttons 119 and 120, and door closed push button 152, are released. Switch 128 serves to extinguish door open indicator 131 when the door is in the fully open position. Contacts 115 and 129 serve to extinguish the door close and door open indicators 116 and 131, respectively, while the door drive motor 63 is in operation.

The teller may over-ride the customer's close door push button 152 by depressing and holding depressed the teller's open door push button 120. The teller can also disable the door in any position at any time by switching the mode switch 110 to the "off" position 167. Further, the teller may elect to over-ride the customer controls and close the entrance by means of the door or closure means 22 by activation of the mode switch 110 to the "close" position. The booth is also removed, if desired, from normal service by moving the mode switch 110 to the "off" position 167 which will extinguish the indicators and disable the controls.

Upon the advent of an alert signal from any source, for example, the teller's alert push button 138, the alert indicator 141 and the alert relay 130 will be energized and latched by the holding contact 146. Energizing the alert relay 130 will open the normally closed contacts 126 which will cause the open door indicator 131 and the open door push buttons 119 and 120 to be disabled preventing the door from being opened by the drive motor.

Simultaneously, but optionally and indeed preferably, a switching system, for example, a stepping relay, (not shown) may be incorporated in the system to connect a tape recorder to the booth, which is the source of the alert signal. During an alert condition the close door and interface functions are not disabled. The alert condition may be cleared by depressing either the reset alert or master reset push buttons 149 and 147, respectively.

Upon the advent of an alarm signal from any source (such as one of the alarm push buttons 164) the alarm relay 137 and the alarm indicator 155 will be energized and latched by the holding contact 170. At this time, a signal will be provided through th alarm bus 159 to energize the alert relay 130 and alert indicator 141 of the booth, and where a plurality of booths are present in the transaction area, the foregoing relays 130 and indicators 141 of all of these booths simultaneously. Diodes 157 and 158 shown in FIG. 21 serve to isolate the alert system, alarm system and the alarm bus 159 to prevent interference between these portions of the circuitry.

Energizing the alarm relay 137 will open the normally closed contacts 112 disabling the open door and close door indicators 116 and 131, the open door and close door push buttons 119, 120 and 152 and the interface or pass-through solenoid 117, thus securing the entrance of the booth which is the source of the alarm.

The alarm transmit loop contacts 161, normally closed, will open and transmit an alarm to a remotely positioned supportive security unit outside the transaction area, such as the police. Further, the alert condition at all the booths, initiated as described hereinabove, by the alarm bus 159 will disable the door opening function at all the remaining booths. The alarm condition also activates the switching system (not shown), in a preferred embodiment, to connect the tape recorder and the tape player to the booth which is the source of the alarm. During an alarm condition or state the alert relays 130 cannot be reset. The alarm condition is cleared by depressing the reset alarm push button 172. The alert condition will, however, persist until reset. Operation of the master reset push button 147 will clear the alarm relay 137 and alert relay 130 of each of the booths involved simultaneously. The alert and alarm reset controls are located on a master control panel (not expressly shown in FIG. 21) positioned in a protected area remote from, and unavailable to, the teller at the booth interface.

At any time the door or closure means can be opened by operation of the emergency open door switch 139 located on the foregoing master control panel. Also located on this master control panel is the key switch enable switch 153 which enables the so-called police key switch 154, allowing the closure means to be opened or closed at any time under supervision of the appropriate authorities. Diodes 143 and 145 serve to isolate portions of the circuitry to prevent interference between the emergency door open switch 139, the normal door open control and the alert system. Switches 122, 123, 134 and 135 are desirably incorporated for protection of the motor controller 62 (shown diagrammatically in FIG. 20, as noted hereinabove) and the motor 63 (also shown diagrammatically in FIG. 20). Safety switches 121 and 133 provided on the door edges 23 stop the door in case a body is between the door edge and booth frame 14.

It will be obvious to one skilled in the art to which this invention pertains that duplication of certain of the components in a number of locations described in the foregoing detailed application of the present invention is appropriate. By way of illustration, indicators are desirably duplicated on the customer's control panel within the booth, and the teller's and master control panels. In like manner, the alarm push button 164 or similarly convenient control means may be incorporated in the teller's station and in the master panel.

It wil be evident that in the detailed control system of FIG. 21 the interface or pass-through 13 must be secured in the closed position before the closure means 22 can be unsecured or opened. For this purpose the limit switch 127 will be closed by the closure of the interface or deactivation of the banking machine exchage unit to enable the door open controls. The transaction interface or pass-through solenoid 117 must in turn be energized to unsecure, and if desired, open the interface 13 or activate the bank machine 38. The foregoing solenoid 117 can, in addition, only be energized when the closure means is fully closed. This is effected by the limit switch 114 which is operated only when the door or closure means is fully closed to enable the interface to be unsecured.

Although the control of the security system is achieved through electrical circuitry such as described hereinabove, the control system may at least partly utilize mechanical, optical, hydraulic, pneumatic or other fluidic or equivalent means to effect movement of a member such as the door 22, or pass-through closure 32.

It will be evident that the term "transaction security system" or its equivalents as employed herein contemplate not only exchange units in which physical passage of money, tickets or other items occurs, but delivery of information from a data processing apparatus or visual observation of such apparatus, for example, occurs.

It will be evident, too, that the terms and expressions which have been employed are used as terms of description and not of limitation. There is no intention in the use of such terms and expressions of excluding equivalents of the features shown and described or portions thereof and its is recognized that various modifications are possible within the scope of the invention claimed.

What is claimed is:

1. A transaction processing enclosure for housing of electronic data processing equipment and the like comprising, in combination, at least one access means to the interior of said enclosure; secondary closure means having outer surface conformance in size and shape with and registrable with said access means, said secondary closure means being slidably mounted and movable with respect to said access means to effect the opening and closing thereof; turntable means mounted independently with respect to said secondary closure means, rotatably secured withn said enclosure and capable of supporting said equipment thereon so that the entire periphery of said turntable means and supported equipment is accessible through said access means; means for providing controlled environmental conditions for the operation, maintenance and security of electronic data processing equipment within the interior of said enclosure, and control means interacting with said secondary closure means to alternatively provide access or non-accessibility to the equipment disposed within said enclosure from the exterior of said enclosure; and for activating said secondary closure means to effect access or non-accessiblity to said equipment within said enclosure in response to said environmental conditions of operation, maintenance or security.

2. A transaction processing enclosure as claimed in claim 1, wherein said secondary closure means is segmented horizontally to form a plurality of independently movable closure means providing selective access to upper and lower portions of said enclosure.

3. A transaction processing enclosure as claimed in claim 1, wherein said enclosure comprises at least two vertically disposed compartments including a transaction exchange unit and a vault; said secondary closure means being segmented horizontally to provide upper and lower independently movable closure elements adapted to provide non-accessibility and access to each of said transaction exchange unit and said vault.

4. A transaction processing enclosure as claimed in claim 1, wherein said control means is electrical.

5. A transaction processing enclosure as claimed in claim 1, wherein said secondary closure means is composed of two independently movable concentrically mounted closure elements.

6. A transaction processing enclosure as claimed in claim 4, wherein said concentrically mounted closure elements comprise an outer transparent enclosure shield adapted to preserve a controlled environment within said enclosure while permitting observation of electronic data processing equipment disposed therein; and an inner fire and impact resistant enclosure shield.

7. A secured transaction processing system comprising, in combination: an outer security enclosure, a booth housing, an interior within said housing, entrance means thereto, internally positioned transaction interface means and closure means positioned substantially within said booth housing to cooperate with said entrance means and providing a closed security enclosure having occupancy entrance capability, said closure means being generally arcuate in shape, of diameter smaller than the width of said booth housing and being slidably mounted and arcuately movable from one to another position with respect to said entrance means, orientation in one position of said closure means providing an occupancy entrance to said booth housing and orientation in another position closing said occupancy entrance with said closure means while providing accessibility to said transaction interface means positioned in said security booth housing; and control means interacting between said security booth and said closure means and adapted to move said closure means from said one position to another position to provide such occupancy entrance and transaction interface accessibility within said closed security booth; and encapsulated within the interior thereof at least one transaction processing enclosure for the housing of electronic data processing equipment and the like comprising, in combination, at least one access means to the interior of said enclosure; secondary closure means having outer surface conformance in size and shape with and registrable with said access means, said secondary closure means being slidably mounted and arcuately movable with respect to said access means to effect the opening and closing thereof; turntable means mounted independently with respect to said secondary closure means, rotatably secured within said enclosure and capable of supporting said equipment thereon so that the entire periphery of said turntable means and supported equipment is accessible through said access means; control means interacting with said secondary closure means to alternatively provide access or non-accessibility to the equipment disposed within said enclosure from the exterior of said enclosure; and means associated with said enclosure for providing controlled environmental conditions within the interior of said enclosure.

8. A secured transaction processing system as claimed in claim 7, wherein said control means are electrical.

9. A secured transaction processing system as claimed in claim 7, wherein said booth housing is transparent to preserve a controlled atmosphere therein, and provide visual access to said equipment housed in said transaction processing enclosure; and said secondary closure means being impact-resistant and adapted for closure of said access means in the event of unprogrammed contact with said equipment contained within said enclosure by an outside agency.

10. A secured transaction processing system as claimed in claim 7, wherein said transaction processing enclosure is generally cylindrical and comprises a stationary arcuate vertical side wall; a transaction interface registrable with the lateral margins of said side wall; closure means of generally arcuate shape and conforming in size and shape and registrable with the lateral margins of said stationary side wall; a ceiling partition in fixed engagement with said stationary side wall and in registry with said second closure means; an upper rotatable element secured to said ceiling partition about the periphery of which are mounted said closure means; a base member disposed about the opposite end of said second enclosure and in fixed engagement with the adjacent stationary side wall; and a turntable mounted on said base about an axis common to that of said upper rotatable element and adapted to receive and support apparatus thereon; said turntable being in registry with said closure means.

11. A secured transaction processing system as claimed in claim 10, wherein said rotable element is a horizontally disposed plate secured to, and interior of, said ceiling partition by means of a vertically disposed support element rotatably mounted in said partition and extending into said second enclosure.

12. A secured transation processing system as claimed in claim 9, wherein said turntable means is secured to said base by means of a vertically disposed second support element rotatably mounted in said base and extending upwardly therefrom into said second enclosure and along an axis common to that of said first support element in said ceiling partition.

13. A secured transaction processing system as claimed in claim 9, wherein said ceiling partition and said base, or a combination thereof, are perforated and adapted for interaction with environmental control means disposed externally of said transaction security system.

14. A secured transacton processing booth comprising, in combination: an outer security booth composed of a booth housing having an interior within said housing, entrance means therethrough, internally positioned transaction interface means and closure means positioned substantially within said booth to cooperate with said entrance means and slidably mounted and arcuately movable with respect to said entrance means to effect the opening and closing of said booth; and control means interacting between said booth and said closure means and adapted to secure said entrance means while simultaneously providing access to said transaction interface means in one position and, alternatively, in another position, to open said entrance means and simultaneously provide for non-accessibility to said transaction interface means; and, in the interior thereof, at least one transaction processing enclosure for the housing of electronic data processing equipment and the like comprising, in combination, at least one access means to the interior of said enclosure; secondary closure means having outer surface conformance in size and shape with and registrable with said access means, said secondary closure means being slidably mounted and arcuately movable with respect to said access means to effect the opening and closing thereof; turntable means mounted independently with respect to said secondary closure means, rotatably secured within said enclosure and capable of supporting said equipment thereon so that the entire periphery of said turntable means and supported equipment is accessible through said access means; electrical control means interacting with said secondary closure means to alternatively provide access or non-accessibility to the equipment disposed within said enclosure from the exterior of said enclosure; and means associated with said enclosure for providing controlled environmental conditions within the interior of said enclosure.

15. A secured transaction processing system comprising, in combination; an outer security booth having an outer booth housing enclosing an interior and entrace means thereinto, closure means to cooperate with said entrance means and mounted and movable from one position to another with respect to said entrance means to permit occupant entry into said booth, and control means associated with said booth, interacting between said outer housing and said closure means and adapted to admit occupancy to the interior of said booth under security conditions and to provide accessibility to at least one transaction processing enclosure positioned in the interior of said booth; said transaction processing enclosure having at least one access means to the interior of said enclosure; secondary closure means having outer surface conformance in size and shape with and registrable with said access means, said secondary closure means being slidable mounted and arcuately movable with respect to said access means to effect the opening and closing thereof; turntable means mounted independently with respect to said secondary closure means, rotatably secured within said enclosure and capable of supporting equipment thereon so that the entire periphery of said turntable means and supported equipment is accessible through said access means; electrical control means interacting with said secondary closure means to alternatively provide access or non-accessibility to the equipment disposed within said enclosure from the exterior of said enclosure; and means associated with said enclosure for providing controlled environmental conditions within the interior of said enclosure.

16. A secured transaction processing center as claimed in claim 16, wherein said outer booth housing is transparent and impact resistant.

17. A secured transaction processing system as claimed in claim 15 wherein said equipment is data processing apparatus.

18. A transaction security booth comprising in combination:

a booth housing;

an interior within said housing;

entrance means thereto;

closure means positioned, in cooperation with said booth housing, having occupancy entrance capability and interacting with said entrance means to provide a closed security enclosure positioned within said housing and inaccessible directly to the exterior of said housing through said closure means;

said closed security enclosure having internally positioned transaction interface means;

said closure means being generally arcuate in shape, of diameter smaller than that of said booth housing, and rotatably mounted on an axis substantially parallel to that of said booth; and arcuately movable from one to another position with respect to said entrance means; orientation in one position of said closure means providing entrance solely to said occupancy entrance capability and orientation of said closure means in another position closing said occupancy entrance capability from accessibility to the exterior of said booth housing through said entrance means while providing access to said closed security enclosure; and control means adapted to move said closure means from said one position to another position;

and disposed within said closed security enclosure at least one transaction processing enclosure for the housing of electronic data processing equipment and the like comprising, in combination, at least one access means to the interior of said equipment enclosure; scondary closure means having outer surface conformance in size and shape with and registrable with said access means, said secondary closure means being slidably mounted and arcuately movable with respect to said access means to effect the opening and closing thereof; turntable means mounted independently with respect to said secondary closure means, rotatably secured within said equipment enclosure and capable of supporting said equipment thereon so that the entire periphery of said turntable means and supported equipment is accessible through said access means, control means interacting with said secondary closure means to alternatively provide access or non-accessibility to the equipment disposed within said equipment enclosure from the exterior of said enclosure; and means associated with said enclosure for providing controlled environmental conditions within the interior of said enclosure.

* * * * *

UNITED STATES PATENT OFFICE

CERTIFICATE OF CORRECTION

Patent No. 4,121,523 Dated October 24, 1978

Inventor(s) Otis H. Hastings

It is certified that error appears in the above-identified patent and that said Letters Patent are hereby corrected as shown below:

In the Specifications:

Column 3, line 1 cancel "macine" and substitute--machine--

Column 3, line 38 cancel "opened" and substitute--open--

Column 4, line 14 cancel "aid" and substitute--said--

Column 5, line 53 cancel "suport" and substitute--support--

Column 6, line 5 cancel "insecuring" and substitute--unsecuring

Column 6, line 15 before "closure" insert -- door or--

Column 6, line 37 omit "the designation".

Column 6, line 43 cancel "the expression".

Column 7, line 7 cancel "sield" and substitute--shield--

Column 7, line 16 after "closure means" insert--or door 22--

Column 8, line 12 cancel "clus-" and substitute--claus-

Column 8, line 18 cancel "door 22" and substitute--closure means--

Column 8, about line 30 cancel "leving" and substitute--leaving

Column 8, line 38 cancel "where present".

Column 9, line 40 cancel "acurately" and substitute--arcuately.

Column 10, line 34 cancel "200" and substitute--220--

Column 10, line 55 cancel "200" and substitute--220--

Column 11, line 1 cancel "rizontally,".

Column 12, line 45 cancel "subdivisional"and substitute--subdivisions--.

Column 15, line 35 after "opaque" insert--secondary--

UNITED STATES PATENT OFFICE

CERTIFICATE OF CORRECTION

Patent No. 4,121,523 Dated October 24, 1978

Inventor(s) Otis H. Hastings

It is certified that error appears in the above-identified patent and that said Letters Patent are hereby corrected as shown below:

Column 16, line 53 cancel "to" and substitute--or--

Column 23, line 20 cancel "wil" and substitute--will--

In the Claims:

Claim 11, line 2, cancel "rotable" and substitute--rotatable--

Claim 15, line 3, cancel "entrace" and substitute--entrance--

Claim 18, line 35 (column 28, line 9) cancel "scondary" and substitute--secondary--

Signed and Sealed this

Eighth Day of May 1979

[SEAL]

Attest:

RUTH C. MASON
Attesting Officer

DONALD W. BANNER
Commissioner of Patents and Trademarks